US006309086B1

(12) United States Patent
Tomlinson

(10) Patent No.: US 6,309,086 B1
(45) Date of Patent: Oct. 30, 2001

(54) DECORATIVE HIDDEN LIGHT ASSEMBLY

(76) Inventor: Christine Sue Tomlinson, 240 Alosta Pl., Camarillo, CA (US) 93010

( * ) Notice: Subject to any disclaimer, the term of this patent is extended or adjusted under 35 U.S.C. 154(b) by 0 days.

(21) Appl. No.: 09/321,752

(22) Filed: May 28, 1999

Related U.S. Application Data

(60) Provisional application No. 60/087,616, filed on Jun. 2, 1998.

(51) Int. Cl.[7] ..... F21V 21/00

(52) U.S. Cl. ..... 362/249; 362/145; 362/240; 362/374

(58) Field of Search ..... 362/240, 248, 362/249, 374, 375, 152, 145, 151

(56) References Cited

U.S. PATENT DOCUMENTS 3,210,538 * 10/1965 Picha et al. ..... 362/375
3,692,993 * 9/1972 Robinsion ..... 240/10
4,511,953 * 4/1985 Fage ..... 362/230
5,311,414 * 5/1994 Branham, Sr. ..... 362/249
5,404,279 * 4/1995 Wood ..... 362/145
5,416,680 * 5/1995 Holmes et al. ..... 362/282
5,510,966 * 4/1996 Konecny ..... 362/249

* cited by examiner

*Primary Examiner*—Sandra O'Shea
*Assistant Examiner*—John Anthony Ward
(74) *Attorney, Agent, or Firm*—Goldstein Law Offices P.C.

(57) ABSTRACT

A holiday lighting assembly, for allowing Christmas lights to be permanently mounted upon a building near the eaves of said building, and for allowing selective display of the lights during the appropriate season, comprising a housing mounted to the building. The housing has an open front, and a pair of sides. The lights are located inside the housing, extending between the sides. A front flap selectively covers the open front in order to conceal the lights. Pins on the front flap mate with slots in the sides of the housing, to allow the front flap to pivot upward and slide into the housing to allow the lights to be displayed.

2 Claims, 2 Drawing Sheets

DECORATIVE HIDDEN LIGHT ASSEMBLY

CROSS REFERENCES AND RELATED SUBJECT MATTER

This invention relates to subject matter contained in provisional patent application Ser. No. 60/087,616, filed in the United States Patent Office on Jun. 2, 1998.

FIELD OF THE INVENTION

The invention relates to a decorative hidden light assembly. More particularly, the invention relates to a holiday lighting assembly which can be concealably installed upon a residential or commercial structure during non-holiday seasons, such that a series of lights contained within said assembly can be exposed during desired holidays.

BACKGROUND OF THE INVENTION

Seasonal light displays are commonly installed around the eaves, windows and doorways of residential and commercial structures. These assemblies usually comprise lengthy strings of weatherproof light bulbs which are fastened to the fascia of the building or under the roof line by means of nails, staples or other suitable semi-permanent fasteners. As the celebrated holiday season passes, it is common practice to remove these light displays and store them indoors rather than leave them installed and un-illuminated until the next holiday. Upon so removing these assemblies, however, the fascia of the building is often marred and damaged due to the removal of the semi-permanent fasteners such as nails or staples. The constant installment and removal of these assemblies over the course of several years (which tends to consume great amounts of time) also manages to seriously damage the structure and degrade it's appearance.

A device is needed which dispenses with the requirement of installing and removing holiday light assemblies several times a year. Such a device would preferably provide an attractive light assembly which is concealable during non-holiday periods and thus need not be removed. This device should further protect the light assembly from year-round inclement weather to ensure it's proper operation during holiday seasons.

While prior art units known heretofore may be suitable for the particular purpose employed, or for general use, they would not be as suitable for the purposes of the present invention as disclosed hereafter.

SUMMARY OF THE INVENTION

The present invention relates to a holiday lighting assembly which can be concealably installed upon a residential or commercial structure during non-holiday seasons, such that a series of lights contained within said assembly can be exposed during desired holidays.

In accordance with the invention, there is provided a holiday lighting assembly which can be permanently secured to a building structure yet is designed to expose a plurality of decorative light bulbs during desired holiday seasons and then conceal said light bulbs during non-holiday seasons.

Further in accordance with the invention, there is provided a holiday lighting assembly which is capable of safely concealing the plurality of holiday light bulbs which are contained therein during non-holiday seasons and protecting said bulbs from detrimental weather.

Further in accordance with the invention, there is provided a holiday lighting assembly which possess a cover flap which may be drawn closed during non-holiday seasons to conceal and protect the plurality of light bulbs located therebehind.

The invention is a holiday lighting assembly, for allowing Christmas lights to be permanently mounted upon a building near the eaves of said building, and for allowing selective display of the lights during the appropriate season, comprising a housing mounted to the building. The housing has an open front, and a pair of sides. The lights are located inside the housing, extending between the sides. A front flap selectively covers the open front in order to conceal the lights. Pins on the front flap mate with slots in the sides of the housing, to allow the front flap to pivot upward and slide into the housing to allow the lights to be displayed.

Also in accordance with the invention there is provided a holiday lighting assembly which possesses a plurality of light bulbs which may be colored or clear, and which may configured in a straight or staggered pattern.

To the accomplishment of the above and related objects the invention may be embodied in the form illustrated in the accompanying drawings. Attention is called to the fact, however, that the drawings are illustrative only. Variations are contemplated as being part of the invention, limited only by the scope of the claims.

BRIEF DESCRIPTION OF THE DRAWINGS

In the drawings, like elements are depicted by like reference numerals. The drawings are briefly described as follows.

DETAILED DESCRIPTION OF THE PREFERRED EMBODIMENTS

Figure 1:
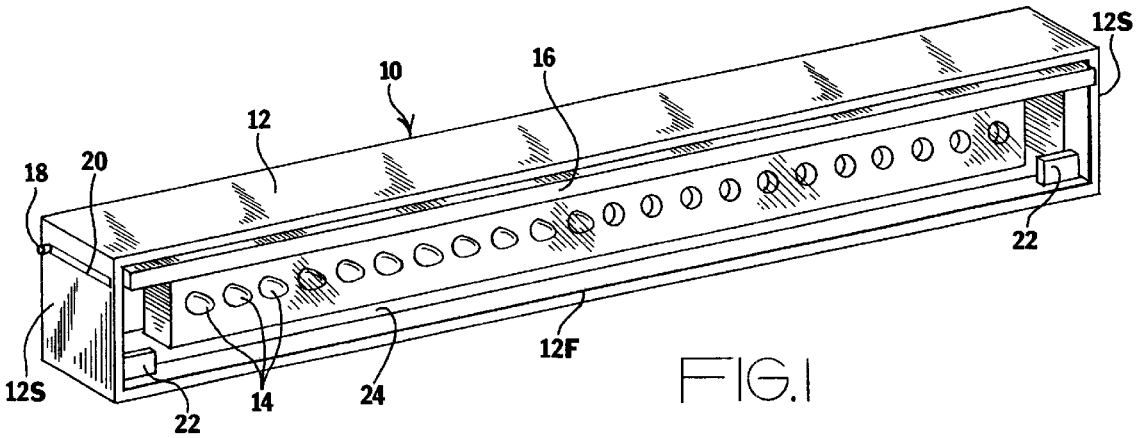
FIG. 1 is a diagrammatic perspective view of a holiday lighting assembly of the instant invention shown with a front cover flap drawn back in an open position to reveal a plurality of light bulbs contained therebehind.

Certain terminology is used in the following description for convenience only and is not limiting. The words "right," "left," "lower" and "upper" designate directions in the drawings to which reference is made. The words "inwardly" and "outwardly" refer to directions toward and away from, respectively, the geometric center of the holiday lighting assembly. The words "proximal end" and "distal end" refer, respectively, to ends of an object nearer to and further from the operator of the object when the object is used in a normal fashion or as is described in the specification.

FIG. 1 illustrates a holiday lighting assembly 10 of the instant invention. The holiday lighting assembly 10 comprises a housing 12 having an open front 12F which has a plurality of electrical light bulbs 14 connected in circuit therein, viewable through the open front 12F. The plurality of electrical light bulbs 14 may be disposed within the housing 12 in either a straight or staggered configuration, according to personal preference. The housing 12 has a front cover flap 16 for selectively covering the open front 12F, which can also be seen in FIG. 2. The housing 12 has a pair of opposite sides 12S. The front cover flap 16 has a pair of pins 18 which extend through corresponding slots 20 which are inscribed into the opposite sides 12S of the housing 12.

Figure 2:
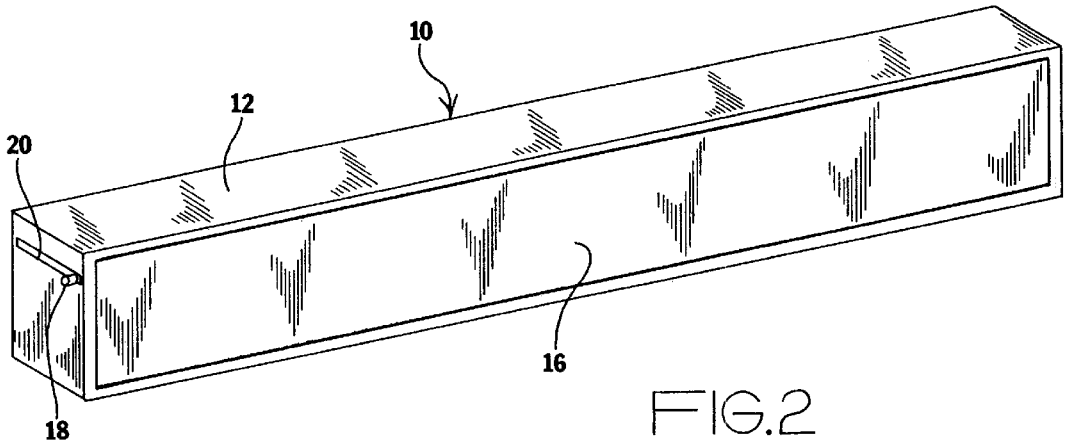
FIG. 2 is a diagrammatic perspective view of the holiday lighting assembly illustrating the front cover flap in a closed position, thus concealing the plurality of light bulbs located therebehind.

Said pins 18 are slideably mounted within the slots 20 and thus allow the front cover flap 16 to pivot upward and to retract as seen in FIG. 1 and expose the plurality of light bulbs 14 located therebehind. Alternatively, the front cover flap 16 may be drawn downward as seen in FIG. 2 to conceal the plurality of electrical light bulbs 14.

Fastening means such as magnets 22, mounted to the housing 12 near the open front 12F, serve to firmly hold the front cover flap 16 in place when it is brought into its closed position. In addition, a moisture barrier shield 24 may be included within the housing in various configurations which serve to further insulate the plurality of electrical light bulbs 14 from harmful effects of weather when the front cover flap 16 is brought to the closed position.

Figure 3:
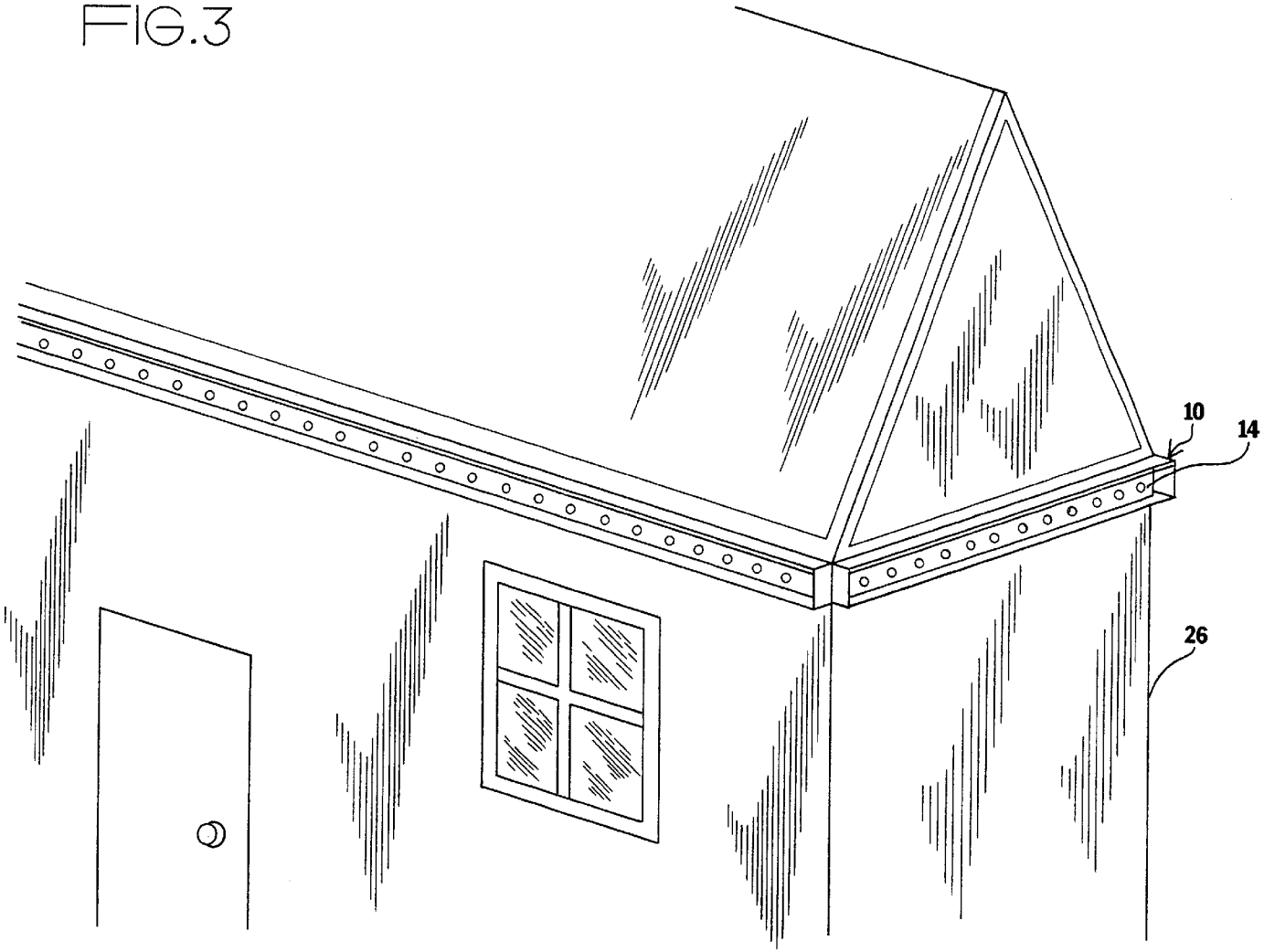
FIG. 3 illustrates the holiday lighting assembly of the instant invention installed upon a building structure.

The holiday lighting assembly 10 is shown installed upon a home 26 having eaves in FIG. 3, wherein the housing 12 is installed near said eaves. As seen in FIG. 3, the front cover flaps 16 of the holiday lighting assembly 10 is in an open position, thus exposing the light bulbs 14 located within the housing 12 for decorative holiday purposes. Upon the passing of the holiday season, the holiday lighting assembly 10 may simply be left in place secured to the eaves of the home 26, and the front cover flaps 16 brought downward to the closed position in order to conceal the light bulbs 14 and shield said light bulbs from harmful effects of the weather. Accordingly, the task of removing the lights 14 and the accompanying damage caused to the home 26 can be avoided.

What is claimed is:

1. A holiday light assembly, for use in permanently mounting holiday lighting to a home and selectively displaying the holiday lighting at appropriate times during the year, comprising:

a housing, the housing having an open front and a pair of opposite sides;

a plurality of lights extending within the housing between the opposite sides, wherein the lights are viewable through the open front;

a front cover flap, secured to the housing, selectively variable between an open position and a closed position, for selectively allowing the lights to be viewed through the open front when in the open position, and for selectively concealing and covering the lights when in the closed position, said front cover flap having a pair of pins; and wherein each of the opposite sides of the housing have a slot such that the pins from the front cover flap are pivotally mounted in the slots to allow the front cover flap to pivot upward and slide backward into the housing to enter the open position.

2. The holiday light assembly as recited in claim 1, further comprising magnets, located in the housing near the open front, for selectively securing the front cover flap when in the closed position.

* * * * *